United States Patent [19]

Granger

[11] Patent Number: 4,844,361

[45] Date of Patent: Jul. 4, 1989

[54] DEVICE FOR DISPENSING WEBS OF MATERIAL ROLLED UP ON A CORE WITH AUTOMATIC DEVICE FOR REPLACING THE ROLL IN USE BY A STAND-BY ROLL

[76] Inventor: Maurice Granger, 17 rue Marcel Pagnol, 42270 Saint Priest en Jarez, France

[21] Appl. No.: 58,851

[22] Filed: Jun. 5, 1987

[30] Foreign Application Priority Data

Jun. 9, 1986 [FR] France ..... 86 08615

[51] Int. Cl.[4] ..... B65H 19/12; B65H 35/08; A47K 10/36

[52] U.S. Cl. ..... 242/55.3; 242/68.5; 312/38; 225/93

[58] Field of Search ..... 242/68.5, 55.2, 55.3, 242/55.53; 312/38–40; 225/93, 103

[56] References Cited

U.S. PATENT DOCUMENTS 3,700,181 10/1972 Diring et al. ..... 242/55.3
4,452,315 11/1985 Granger ..... 242/55.3

FOREIGN PATENT DOCUMENTS 2364838 4/1978 France .
2402613 4/1979 France .

*Primary Examiner*—David Werner
*Attorney, Agent, or Firm*—Eric P. Schellin

[57] ABSTRACT

The device is featured by a combination of: lateral slideways (**5*d*–5*e*) taking with backlash, rods (26*d*–26*e*) integral with supporting means (26) for the rolls; articulated supporting means (10) to suspend the stand-by roll (R2) in a waiting position by its rods (26*d*–26*e*); articulated means (8) for hooking and taking pressing rods (26*d*–26*e*) of the roll in use (R1) on a drum (1) for driving of the said roll and cutting manually pulled web; a first connecting rod (12) between means (8) and (10) is mounted so that the said means can be separated or brought together by crossing each other; a second connecting rod (18) hinged with substantial backlash on the hooking means (8), and also articulating on the end of a lock (19) retaining the stand-by roll (R2); safety means locking at least in one rotation direction, the drum (1**) during use or refilling.

3 Claims, 3 Drawing Sheets

DEVICE FOR DISPENSING WEBS OF MATERIAL ROLLED UP ON A CORE WITH AUTOMATIC DEVICE FOR REPLACING THE ROLL IN USE BY A STAND-BY ROLL

This invention relates to a device for dispensing webs of material on a core, with an automatic replacing device for the roll in use with a stand-by roll.

The object of the invention relates to the technical sector of means for dispensing webs of material rolled up on cores. More particuarly, but in a non-limitative manner, the invention relates to devices for dispensing and simultaneous cutting of webs of wiping materials.

Devices dispensing wiping materials are known, which are equipped to take several rolls and to ensure possible continuous and automatic replacement of an empty roll and the dispensing of a new one.

This is the case, particularly for devices forming the object of prior Patents from the applicant.

In one of these devices (French Pat. No. 2,364,838), the rolls of wiping material are arranged directly one on top of the other, with their pins or ends, sliding in lateral slideways, and fixed to different mechanisms combined to automatically execute the replacement of the roll in use when it is empty. However, in the embodiment, when the device is refilled, it is necessary to operate the resetting control manually.

In the other device (French Pat. No. 83.00737 and Addition 83.10533) as well as in another French Pat. No. 2,402,613, the rolls of wiping material are mounted on support arms with the stand-by roll locked in position until the roll in use is nearly empty, some mechanisms connected to the support arm of this roll, control the unlocking of the stand-by roll.

For Patent 83.00737 and its Addition, the two support arms are hinged on a fixed structure and are connected to each other by a connecting rod judiciously mounted so that when the stand-by roll is transferred, the said support arms can cross over and thereby relay themselves so as to transfer the stand-by roll, obviously the roll in use which is nearly, empty, falls to the bottom of the device through gravity, to leave room for the stand-by roll. If this design is satisfactory, it is necessary to note that the principle developed requires a large bulk and the relating mechanisms which are complex and costly.

For the Patent 2,402,613, only the support arm of the stand-by roll is pivotally mounted and connected to its locking mechanism, whereas the roll in use is mounted on a fixed support; the core of the said roll stays in place when it is empty. It can be imagined that the weight of the stand-by roll applied to the contact rollers wedged between the said roll and the core of the empty roll, generally made from cardboard, do not enable smooth and reliable operation of the device. Furthermore, the device cannot be refilled before the second roll is completely used up without fastidious handling.

The device according to this invention remedies these disadvantages in as mush as it enables the roll in use to be replaced by a stand-by roll completely automatically and quick and easy refilling of the device without having to wait until the roll in use is used up, this along with simplified mechanisms with reduced dimensions, mainly in depth and is outstandingly smooth and reliable to operate. Also, the device enables the dispensing of rolls of different widths and diameters.

According to a first feature, the dispensing device comprises, a combination of arms to suspend the stand-by roll in a waiting position, hook shaped arms to support the pressure from the roll in use on the periphery of a drum in a well known manner, an automatic cutting mechanism for the web of material dispensed through manual pulling on the end accessible under the device, the said arms being connected to each other by means of a connecting rod so as to come closer together and cross each other and lateral slideways to take the backlash of the pins projecting from the spooling on cores of the rolls; a second connecting rod, hinged to one of the arm hooks and a pivoting lock, being provided to free the stand-by roll when the roll in use which is nearly empty, is ejected. Other specific objects and advantages will appear as the specification proceeds.

In order to clarify the object of the invention without limiting it, the invention is accompanied by the following drawings in which.

Figure 1:
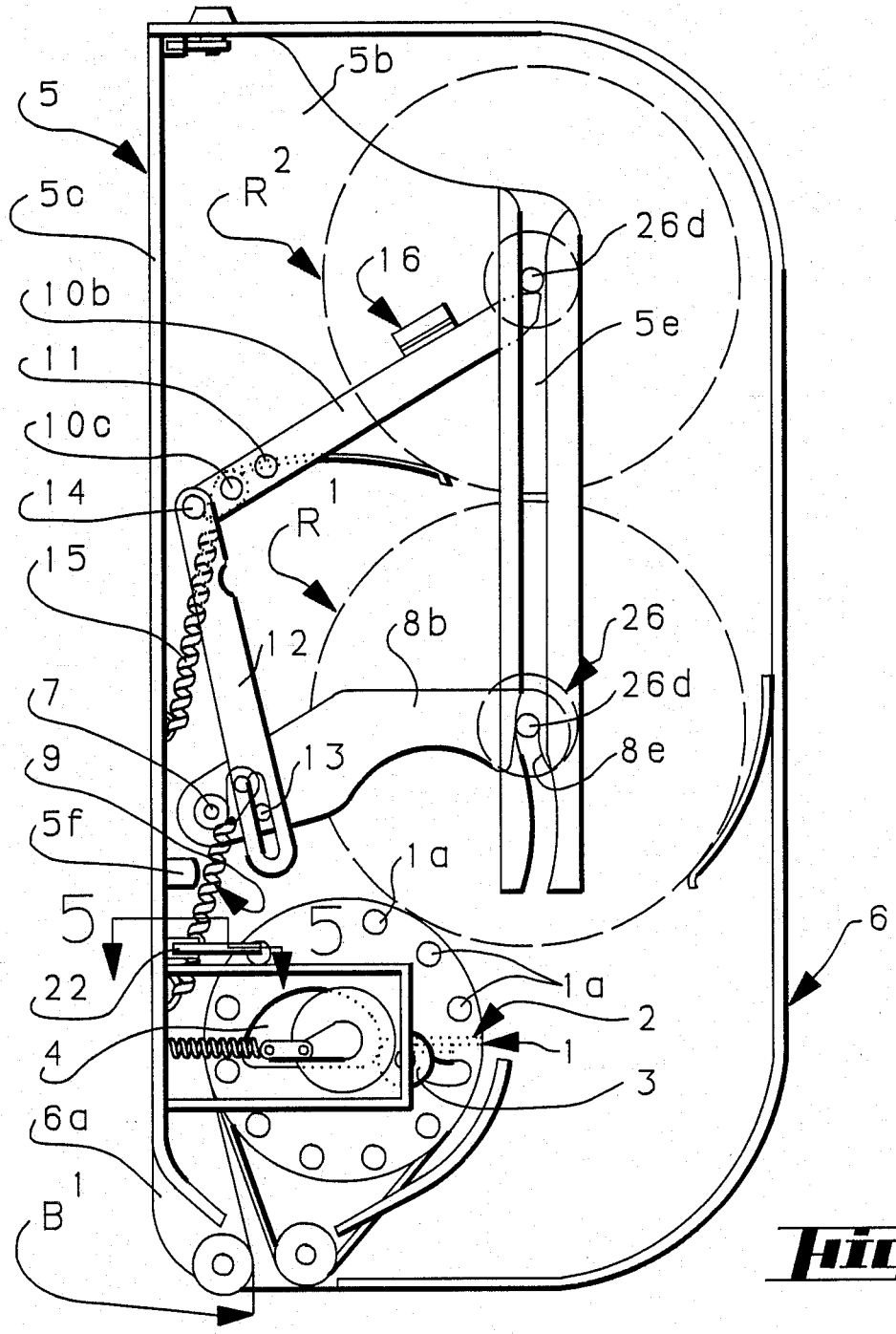
FIGS. 1 and 2 are side views of the device shown with two new rolls.

The object of the invention will become apparent from the following non-limitative embodiment illustrated in the accompanying drawings.

In everything that follows, the invention is described in a non limitative manner on a device for dispensing and simultaneously and automatically cutting webs of wiping materials by means of simple pulling on the web projecting under the device. This type of device is covered under numerous Patents of which the applicant is the patentee.

It is very briefly recalled that with this type of device the roll (R1) of material in use is directly applied and pressed to the drum (1) held, whilst freely turning, by the walls of the casing, and having an anti-slip surface so as to be firmly driven by means of pulling on the material. A pinked cutting blade (2) is mounted on the inside of the drum and is connected to an outside roller (3) which is in contact with a fixed cam (4) designed so as, when the web of material is manually pulled from the end projecting (B1) from the roll, the blade extends from the drum after the roll of material has passed, then it goes back in to the inside into the remaining sector. Different mechanisms are connected to the drum and walls of the casing to enable the drum to rotate and then stop after cutting, the projection of a new web of material and the freeing of the drum ready for a new pulling operation of the projecting web.

Obviously the device according to the invention may be implemented into other types of dispensers without departing from the essence of the invention. With reference to figures of the drawings, the device according the invention shall now be described.

The lateral walls (**5*a*–5*b*) and base (5*c*) of the wall casing (5) holds the mechanism assembly, which is enclosed under a cover (6) hinged on the lower part of the casing and lockable at the opposite end. Each wall directly holds or has a built up slideway (5*d*–5*e***) rectilinear at the largest part of its height then curved at the inside end and flared at the top so as to facilitate the insertion of the rolls of wiping material. The slideways are wider at the top than the diameter of the guiding means of the rolls and have a height calculated so as to take and guide the two rolls until the roll in use is nearly used up.

A means (B) destined to apply the roll of material in use on the drum is hinged on pins (7) above the drum (1). This means comprises two arms (8*a*–8*b*) connected by a spacer (8*c*), the free ends of which are hooked (8*d*–8*e*) with their opening substantially rounded and pointing downwards. A spring (9), preferably clad to avoid catching with the material to be dispensed and pressed against a stop (5*f*) of the casing base, returns the arms towards the drum so as to enable the pressure of the roll (R1) in use which is thereby hooked by the ends projected from its core.

Higher up, a second means (10) is also hinged by means of pins (11) to the casing walls. This means comprises two arms (10*a*–10*b*) connected by means of a spacer (10*c*), its free ends of which are bevelled at the top so as to support the ends projecting from the core of the stand-by roll (R2). A spring (15) returns arms to top position against the sound-absorbing stop (16).

Obviously, the arms (8*a*–8*b*) and (10*a*–10*b*) are designed with such a length so that their ends for hooking and suspending the rolls are situated within the plane of the slideways. It should be noted that the slideways have a curve at the bottom with the hinge pins (7) of the means (8) in the centre.

The two means (8) and (10) are connected to each other by a connecting rod (12) cooperating with the pins (13–14) integral with the arms and fitted inversely with respect to the rotation pins (7) and (11) of the means (8) and (10), so as to be separated or brought together with each other by crossing over themselves.

In this middle or substantially middle part, the arm (8*a*) also has a pin (17) to take a second swivelling connecting rod (18) through its very long slot (18*a*). The connecting rod (18) is hinged at the end of a lock (19) which is pivoted in (20) on a lateral wall of the casing. The top part of the lock (19) is designed so as to support a protruding member (10*d*) integral with one of the arms (10*a* or 10*b*), and a spring (21) returns the lock to a position where it retains the arm (8*a*).

Obviously when the two rolls are new and in position in the device, the stand-by roll (R2) is held by arms (10*a*–10*b*) at a sufficient height so as not to be in contact with the roll (R1).

Figure 5:
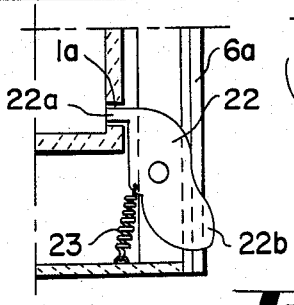
FIG. 5 is a partial section considered on the line 5—5 of FIG. 1, showing a temporary locking device of the driving and cutting drum.

Again, it is to be noted that a locking means has been provided for the driving and cutting drum when the cover (6) is open so as to avoid any risk of an accident with the cutting blade. For this purpose and as illustrated in FIGS. 1 and 5, a pivoting catch (22) is fitted on the casing in such a way so that its forwardly extending portion (22*a*) can penetrate, when urged by a return spring (23), into at least one opening (1*a*) of the drum wall (preferably, a plurality of equally-spaced openings are made). In this position, the opposed and profiled part (22*b*) of the catch projects from the lateral wall of the casing so as to be pushed back in by a wing (6*a*) of the cover on closing thereby unlocking the drum.

Figure 2:
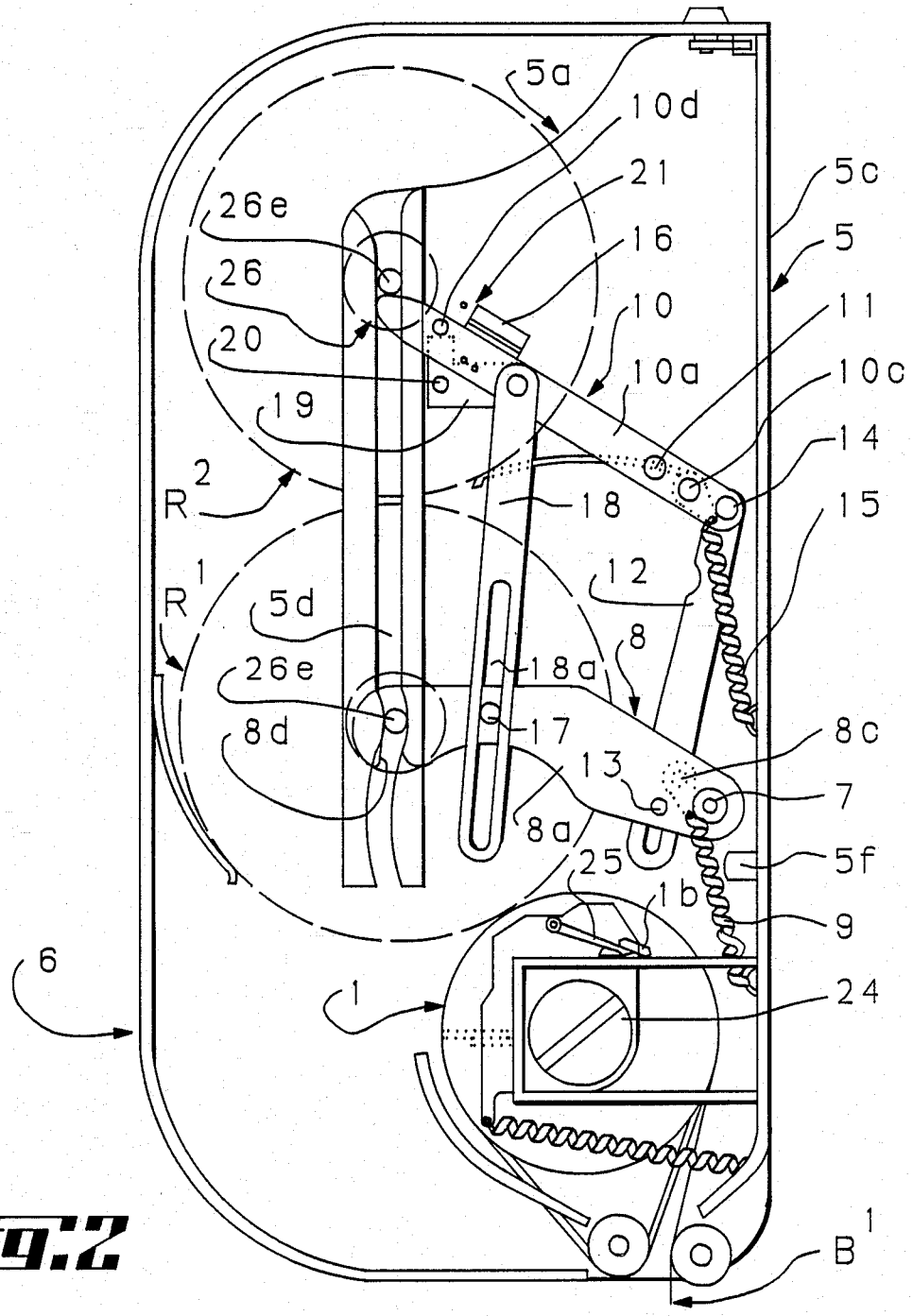

Another safety device illustrated on FIG. 2 is provided in order to prevent the backward return of the drum on the end of the cutting operation in the event of inverse operation on the operating knob (24) connected to the drum and used for filling the device. It can be seen that the drum (1) has a projection (1*b*) on one of the walls which, when the drum rotates normally, can pass under a ratchet pawl (25) illustrated in dotted lines, and forms part of the mechanisms referred to at the beginning of the description, whereas in the opposite rotating direction of the drum, the projection (1*b*) abuts againsts the said ratchet pawl. This locking prevents the unrolling of the material at the front which could risk the device becoming out of order. According to an important feature of the invention, the structure of the unit enables the mounting and dispensing of rolls of wiping material of different diameters or widths.

With this in mind, it is necessary to provide a sufficiently wide drum and sufficient width between slideways, along with supporting means (26) for rotating rolls of different lengths.

Figure 6:
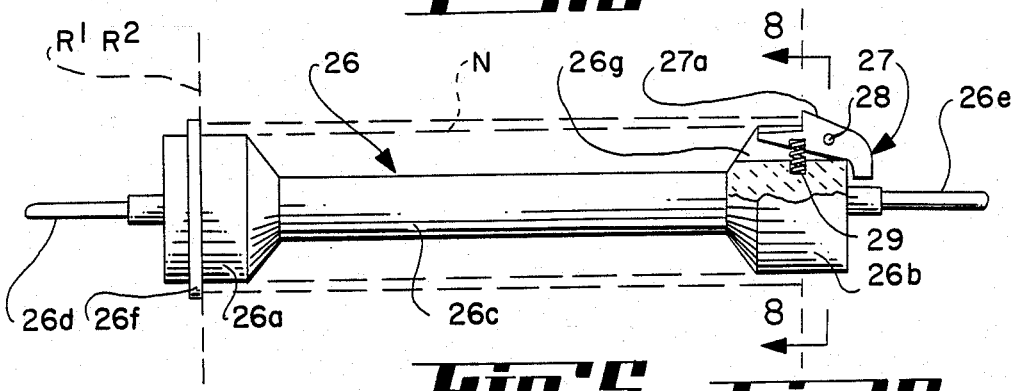
FIG. 6 is a partial section illustrating the roll pins.
Figure 7:
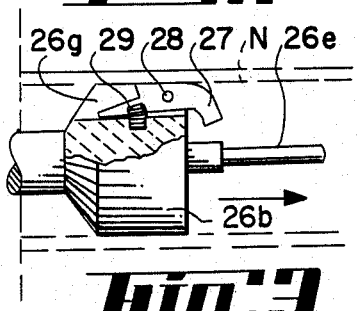
FIG. 7 is a partial section showing the engagement of the roll pin into the core of the roll.
Figure 8:
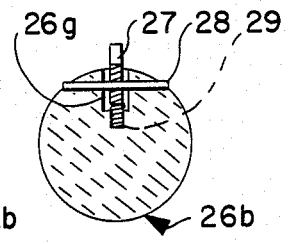
FIG. 8 is a section considered on the line 8—8 of FIG. 6.
Figure 3:
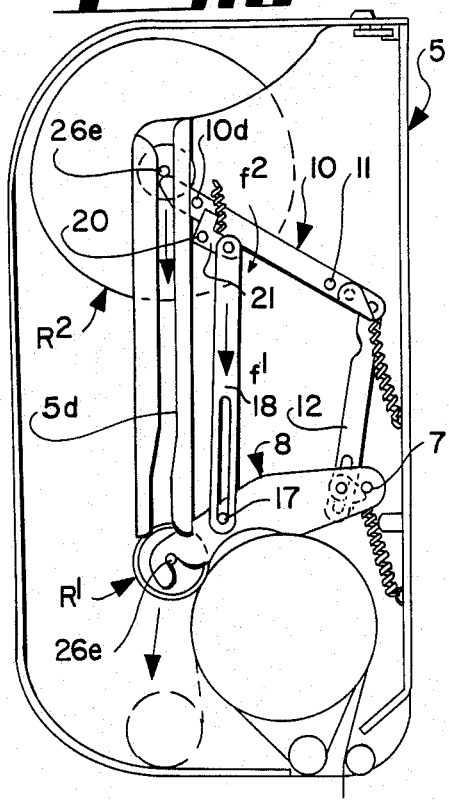
FIGS. 3 and 4 are views on a smaller scale showing two phases of operation of the roll replacement device.

An example of the means used is illustrated in FIGS. 6, 7 and 8. This supporting means holder (26) is made up of two end pieces (26*a*–26*b*) with a diameter corresponding to that of the cardboard core (N) of the roll, connected by a thinner central part (26*c*). At each end, the end pieces are directly extended or extended by built up guiding means or rods (26*d*–26*e*) which are destined to slide with play in the slideways (5*d*–5*e*) and to cooperate with arms (8*a*–8*b*) and (10*a*–10*b*).

One of the end pieces has a collar (26*f*) to be pressed against the end face of the core, whereas the other end piece takes a ratchet pawl (27) in a slot (26*g*) hinged in (28) and returned by spring (29), cleared away during insertion in the core (FIG. 7), then returned when a nose (27*a*) of the ratchet pawl has completely crossed the core (FIG. 6), thereby retaining the roll in a centred position with respect to the slideways.

The operation of the automatic replacing device for the roll in use will now be described referring more specifically to FIGS. 1, 2, 3, and 4.

Figure 4:
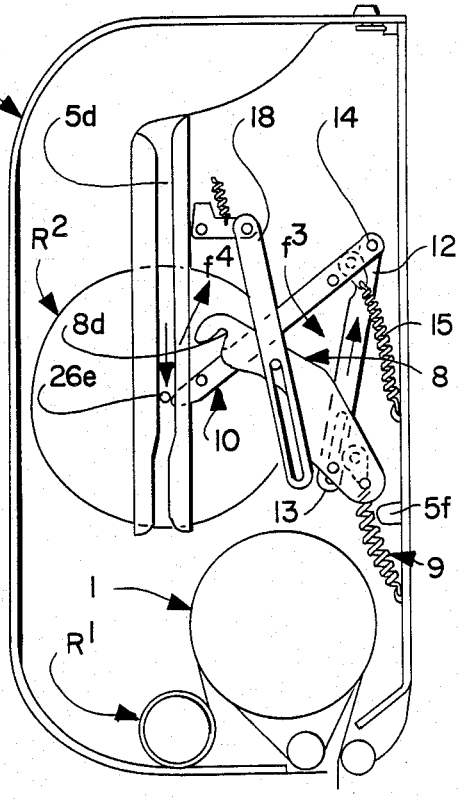

As and when the roll (R1) in use is unrolled, it lowers into the slideways (5*d*–5*e*) whilst being pressed to the drum by the return spring (9). When only a few turns of material are left to be dispensed, the roll (R1) escapes from the slideways and is retained by hooks (8*d*–8*e*) until the pin (17) pulls (arrow f1) on the connecting rod (18), which tilts the lock (19) around its pin (arrow f2); the protruding member (20) escapes from the lock (FIG. 3) which frees the supporting means (10). Through the weight of the stand-by roll (R2), the supporting means (10) pivots (arrow f3) around its pins (11), and the roll (R2) can take the place of the roll (R1) in contact with the drum since, simultaneously, the swivelling of the supporting means (10) enabled the lifting (arrow f4) of the hooking means (8) by their connecting rod (12) and therefore the freeing of the roll (R1) which falls to the bottom of the unit. The positions and movements of the means (8 and 10) are such that the hooks (8*d*–8*e*) are sufficiently lifted so as to be situated, in a backward position to the slideways before coming into contact with the rods (26*d*–26*e*) of the rotation pin of the roll (R2), (FIG. 4).

When the roll (R2) is against or nearly against the drum, the bevelled ends of the arms (10*a*–10*b*) escape from the rods (26*d*–26*e*), and the said arms can then take up their initial position again being returned by the spring (15), which results in the lowering of the arms (8*a*–8*b*) through the connecting rod (12), the hooks (8*d*–8*e*) of the arms can then cover the rods (26*d*–26*e*). At the same time, the lock (19) has also taken up its initial position again (by the spring (21) thereby retaining the supporting means (10) by the finger (10*d*). The unit is now ready to take a new stand-by roll by simple insertion into the slideways.

The ejected roll in use (R1) can be completely used up by simple pulling on the projecting web (B1), which also drives the stand-by roll (R2). So, until the roll (R1) is used up, the user will pull two webs of attached material, then one on its own (that of roll R2), in continuity.

The advantages will become more apparent from the description, but the compact size and simplification of mechanisms with respect to known devices are more particularly underlined as well as the possibility of mounting rolls of different diameters and widths by changing pins (26).

I claim:

1. A device for dispensing discrete portions of a web from a first roll having an axial bore therethrough and an axle extending outwardly from both sides thereof in said bore and storage means for retaining thereabove a second roll of like material having an axial bore therethrough and an axle extending outwardly from both sides thereof, comprising a housing, said housing having access means whereby rolls may be introduced thereinto, an egress means at the bottom of said housing whereby said discrete portions of said web are removable when said device is operated, drum means rotatably mounted internally in said housing and having a surface adapted and constructed to carry a length of the to-be-dispensed web material thereabout, radially reciprocatable cutting means having a cutter blade mounted internal in said drum adapted and constructed to transversely cut said web to thereby produce said discrete portions of said web when said web material is played over said drum and said drum is rotated, a cam linkage means adapted and constructed to operatively thrust said cutting means radially beyond said circumference of said drum means when said drum is rotated, a first retaining means adapted and constructed to biasingly support above and in abutment with said drum the first roll of web material to be dispensed by its extending axle thereof, a second retaining means adapted and constructed to retain in reserve by extending axle a second roll of web material to be dispensed when said first roll is empty above and displaced from said first roll of web material, vertical guide means and including an elonated slot means mounted in said housing adapted and constructed to carry said extending axle portions of said first roll and said second roll, unlatching means for releasing the axle of said first roll when said first roll is empty, said second retaining means including linkage means adapted and constructed to permit said second roll of web meterial to descend vertically with said axle thereof in said guide means, a second linkage means freeing said retaining means when said second roll has descended completely, a third linkage means adapted and constructed to engage said first retaining means to biasingly support above and in abutment with said drum the said second roll of web material, said axle of said rolls having an abutment flange at one end thereof externally of one side of said roll and a locking means mounted proximate said other side of said axle on said other side of said extending axle, said locking means including a spring biased lever adapted and constructed to retract radially when said roll is being mounted on said axle and lies in abutment against the other side portion of said roll.

2. The dispensing device according to claim 1 wherein said drum means has affixed thereto an axially disposed manually rotating means whereby said drum means may be rotated in one direction, said drum means having a side wall, said side wall having a projecting and a ratched pawl mounted in said housing, said projection and said ratched pawl adapted and constructed to permit said drum to rotate in one direction and to prevent the rotation of the drum when rotated in the opposite direction.

3. The dispensing device according to claim 1 wherein said drum means having a side wall, said side wall having a plurality of openings, lever latch means hingedly mounted in said housing, said housing access means in a door, said lever latch means biased in the direction of said openings and to have an end thrust thereto when said door is open, said door and said latch means adapted and constructed whereby said door impinges on said latch means whereby to move and retain the lever latch means in a disengaged position from said openings whereby to permit the drum to rotate when so disengaged and to prevent the drum from rotating in any direction when said door is open.

* * * * *